US005261643A

United States Patent [19]

Wurdack

[11] Patent Number: 5,261,643

[45] Date of Patent: Nov. 16, 1993

[54] APPARATUS FOR LIFTING MODULAR FURNITURE

[75] Inventor: Kirk Wurdack, Landing, N.J.

[73] Assignee: Renovisions, Inc., Edgemont, Pa.

[21] Appl. No.: 8,386

[22] Filed: Jan. 25, 1993

Related U.S. Application Data

[63] Continuation of Ser. No. 842,054, Feb. 26, 1992, abandoned.

[51] Int. Cl.[5] ..... B66F 3/00

[52] U.S. Cl. ..... 254/106; 254/133 R

[58] Field of Search ..... 254/45, 133 R, 134, 254/106, 30

[56] References Cited

U.S. PATENT DOCUMENTS

| | | | |
|---|---|---|---|
| 270,924 | 1/1883 | Barber | 254/106 |
| 569,056 | 10/1896 | Regan . | |
| 640,120 | 12/1899 | Floyd . | |
| 843,292 | 2/1907 | McIntosh . | |
| 1,343,275 | 6/1920 | Mulrihill . | |
| 1,635,291 | 7/1927 | Smith et al. . | |
| 2,255,261 | 9/1941 | Lucker | 254/106 |
| 2,564,541 | 8/1951 | Mallory . | |
| 2,573,877 | 11/1951 | Schweitzer . | |
| 2,721,724 | 10/1955 | Bottorff . | |
| 2,725,946 | 12/1955 | Welter . | |
| 2,760,756 | 8/1956 | Lucker . | |
| 2,823,551 | 2/1958 | Utz . | |
| 3,059,785 | 10/1962 | Buckeye . | |
| 3,309,063 | 3/1967 | Cole . | |
| 3,313,521 | 4/1967 | Sauka . | |
| 3,326,526 | 6/1967 | Takeuchi et al. . | |
| 3,727,291 | 4/1973 | Babb | 254/106 |
| 3,753,550 | 8/1973 | Criswell | 254/133 |
| 3,758,077 | 9/1973 | Fisher | 254/133 |
| 3,850,409 | 11/1974 | Davis et al. . | |
| 3,892,385 | 7/1975 | Andrist et al. . | |
| 4,073,475 | 2/1973 | Gordon . | |
| 4,082,250 | 4/1978 | Allmon et al. | 254/45 |
| 4,203,578 | 5/1980 | Margueratt | 254/133 R |
| 4,281,820 | 8/1981 | Martin . | |
| 4,540,147 | 9/1985 | Lincourt | 254/133 R |
| 4,552,337 | 11/1985 | Wille . | |
| 4,793,592 | 12/1988 | Green et al. | 254/134 |
| 4,846,443 | 7/1989 | Collins et al. . | |
| 5,161,781 | 11/1992 | Sohocki | 254/30 |

FOREIGN PATENT DOCUMENTS

| | | | |
|---|---|---|---|
| 517964 | 11/1955 | Canada | 254/134 |
| 1081682 | 7/1980 | Canada . | |
| 2720985 | 11/1978 | Fed. Rep. of Germany . | |
| 0247511 | 12/1987 | Fed. Rep. of Germany . | |
| 0261339 | 3/1988 | Fed. Rep. of Germany . | |
| 1419192 | 10/1965 | France . | |
| 1424333 | 11/1965 | France . | |

*Primary Examiner*—Robert C. Watson

*Attorney, Agent, or Firm*—Ratner & Prestia

[57] ABSTRACT

An apparatus is provided for lifting modular furniture. The apparatus comprises a central shaft and housing slidably mounted on the shaft. Either the housing or the shaft is supported by a base support and the other of the housing and shaft is moveable. The apparatus further comprises a jig which is adapted to mate with the furniture to be lifted, and means for raising and lowering the jig to thereby raise and lower the furniture. The apparatus further includes a lateral stabilizer which stabilizes the furniture once it is raised off the floor.

19 Claims, 6 Drawing Sheets

APPARATUS FOR LIFTING MODULAR FURNITURE

This application is a continuation of application Ser. No. 07/842,054 filed Feb. 26, 1992 now abandoned.

BACKGROUND OF THE INVENTION

Many modern offices utilize modular furniture to create workspaces for employees. This is because modular furniture is very convenient. It comprises a series of panels, each approximately 5½ feet high and 6 feet wide. The panels are secured together, to form a maze of workspaces. Each panel is equipped with accessory hanging tracks, which are used to install furniture accessories such as desks and bookshelves. The tracks generally comprise metal strips embedded vertically in the face of the panel. The strips include a series of slots arranged vertically in the strip. A desk or other accessory has hooks designed to mate with the slots in the panel and is thus cantilevered off the panel.

Power, phone, and computer network wires are arranged in raceways at the bottom of each panel. In this way, electricity, phone and computer connections can be delivered to each workstation.

The furniture has the advantage of being modular and thus usable in many different configurations. If a business must move an office, the furniture can be broken down, transported and reassembled, whereas if individual workstations were built, they would likely be abandoned at the old location, and new ones constructed. This could add greatly to the cost of the move, whereas furniture panels can be reused without the need for further capital investment.

The modular furniture rests on feet, and is generally arranged on top of whatever floor covering the office chooses to use. In most cases, offices use carpeting for a variety of reasons, including cost, noise suppression, and comfort. However, when the carpeting wears out, all of the modular furniture must be disassembled so that new carpeting can be laid. Carpet tiles, or carpet squares have helped to alleviate this problem. The tiles, which are square about 18 inches on a side, when worn, can be replaced individually. Thus, one may replace the carpet tiles in a high traffic area without the need for replacing entire rooms full of carpeting. However, when the carpet is sufficiently worn that entire rooms are to be recarpeted, again an entire constructed unit of modular furniture must be disassembled so that the old carpet may be removed and new carpet squares laid.

This is generally a procedure which is expensive and disruptive to the business. Each desk and work area must be cleared of all business supplies and personal items. Computer connections must be broken and the computers removed. Each desk, bookshelf, or accessory must be removed from the furniture panels, and all electrical, telephone, and computer network systems must be removed from the panels. The panels are then disassembled. While the old carpet is being removed and new carpet laid, all of the aforesaid items must be stored. Once the carpet is laid, all of the aforesaid items must be reassembled on top of the new carpet. For small offices of 20–30 workstations and 50–100 panels, this probably is accomplished over a weekend or long weekend while business would not otherwise be conducted by the office. However, in larger offices, carpet removal and replacement could cause a substantially longer disruption.

In order to avoid such a substantial disruption, carpet installers have attempted to raise modular furniture slightly off the floor in order to allow carpet tiles to be removed and replaced underneath the furniture. This has met with limited success. Crowbars and other such leveraging devices have been used to slip under the raceway at the bottom of the panel to try to lift the panel. This can severely damage the wire-carrying raceways at the bottom of the panel. Furthermore, the use of such tools creates undue torque and stress on the furniture panels.

The panel raceways are relatively weak. That is they generally cannot support the weight of the panel without undergoing plastic deformation. However, the panels are provided with other, relatively strong structures which can, and may be intended to, support the entire panel without undergoing plastic deformation. For example, the feet of the panels are intended to support the panel. Further, the strips and slots are intended to support the considerable weight of bookshelves and desks. These structures are also relatively strong and can easily support the weight of the panels without undergoing plastic deformation.

SUMMARY OF THE INVENTION

Apparatus for lifting modular furniture, constructed in accordance with the present invention, includes a central shaft and a housing slidably mounted on the shaft. Either the housing or the shaft is supported by a base support and the other of the housing and shaft is moveable. The apparatus further comprises a jig which is adapted to mate with a relatively strong part of the furniture to be lifted. The jig is secured to the moveable portion of the central shaft and housing. That is, if the housing is supported by the base support, the jig is secured to the central shaft. If the central shaft is supported by the base support, the jig is secured to the housing. In this way, the jig will move with either the central shaft or the housing, whichever is capable of movement. The apparatus further includes a lateral stabilizer which stabilizes the panel once it is raised off the floor. Finally, contained within the housing is a means for raising and lowering the mated jig and furniture. The jig may include a row of hooks adapted to mate with the accessory hanging tracks on the furniture panels, or it may include openings adapted to mate with the feet of the furniture panels. Alternatively, the jig may include two parallel rows of hooks which will mate with the accessory hanging tracks on two adjacent panels, or the jig may include at least two openings adapted to mate with feet projecting downward from two adjacent furniture panels. In this way, the jig holds the panels securely together while the furniture is raised.

DETAILED DESCRIPTION OF THE INVENTION

Figure 1:
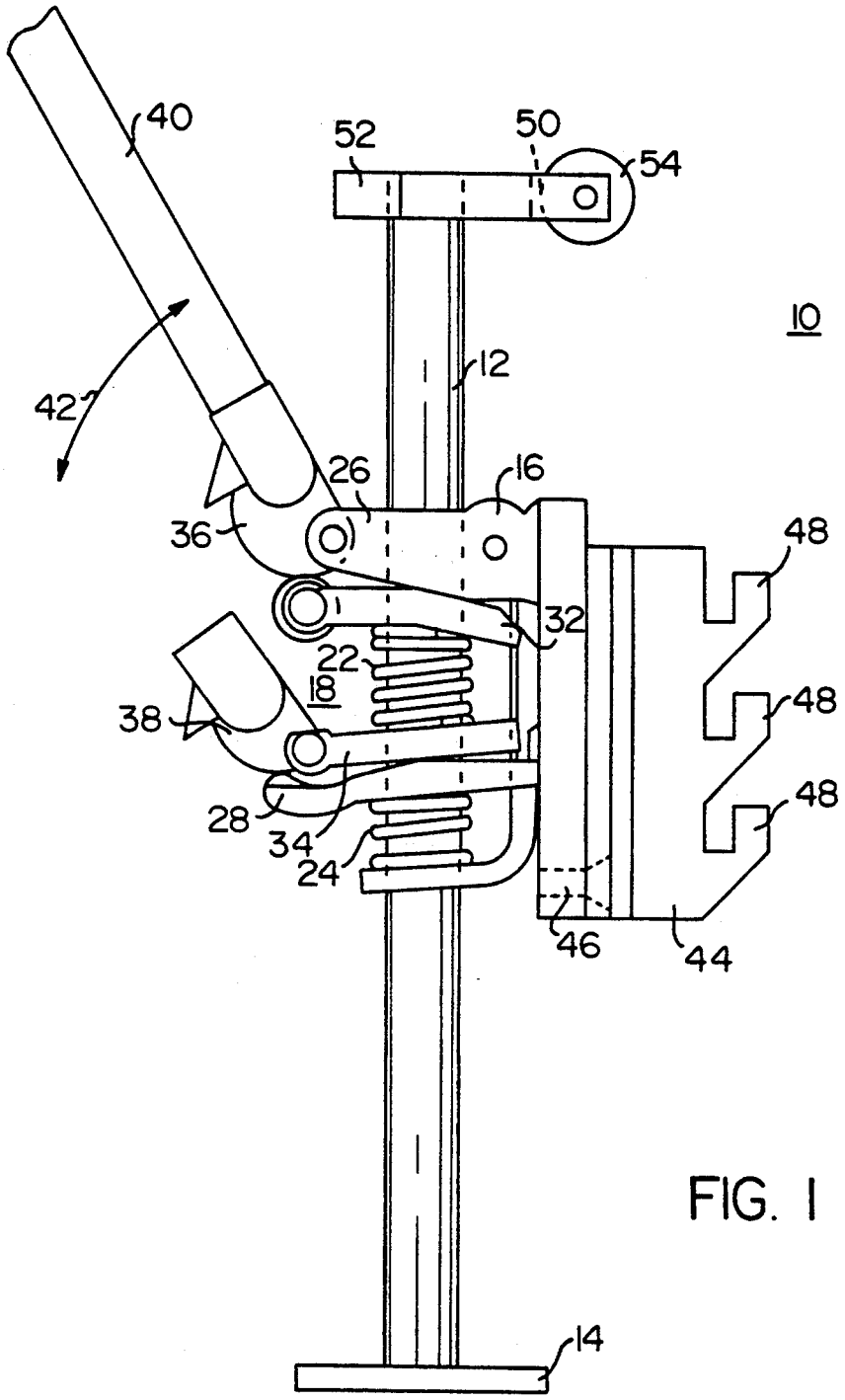
FIG. 1 is a side view of the furniture lifting apparatus of the present invention.

Referring now to FIG. 1, furniture lifting apparatus 10, constructed in accordance with the present invention, comprises a central shaft 12 mounted on a base 14. Slidably mounted on shaft 10 is a housing 16.

Housing 16 is designed to house and form part of a conventional jacking mechanism identified generally in FIG. 1 as 18. Jacking mechanism 18 further comprises an upper spring 22 and a lower spring 24. Mechanism 18 also comprises upper and lower fixed plates 26 and 28, respectively. Hingedly attached to upper fixed plate 26 and lower fixed plate 28 are upper and lower actuators 36 and 38, respectively.

The jacking mechanism is actuated by inserting a leverage bar 40 into either the upper actuator 36 or the lower actuator 38. As shown in FIG. 1, leverage bar 40 is inserted into upper actuator 36. The leverage bar is then reciprocated as shown by arrow 42. This causes movement of upper movable plate 32 and forces housing 16 vertically upward on shaft 12. Leverage bar 40 is then returned to its starting position as shown in FIG 1. To lower housing 16 on shaft 12, the leverage bar 40 is placed in lower actuator 38. Upon moving leverage bar 40 downward, lower movable plate 34, to which lower actuator 38 is hingedly attached, moves upward with respect to housing 16. However, lower movable plate 34 is stationary with respect to shaft 12 forcing housing 16 downward on shaft 12. In this way, the jacking mechanism may be lowered.

Jacking mechanisms of this type are generally known, and one such jacking mechanism is fully described in U.S. Pat. No. 2,823,551 to H. Utz, which is incorporated herein by reference.

Figure 2:
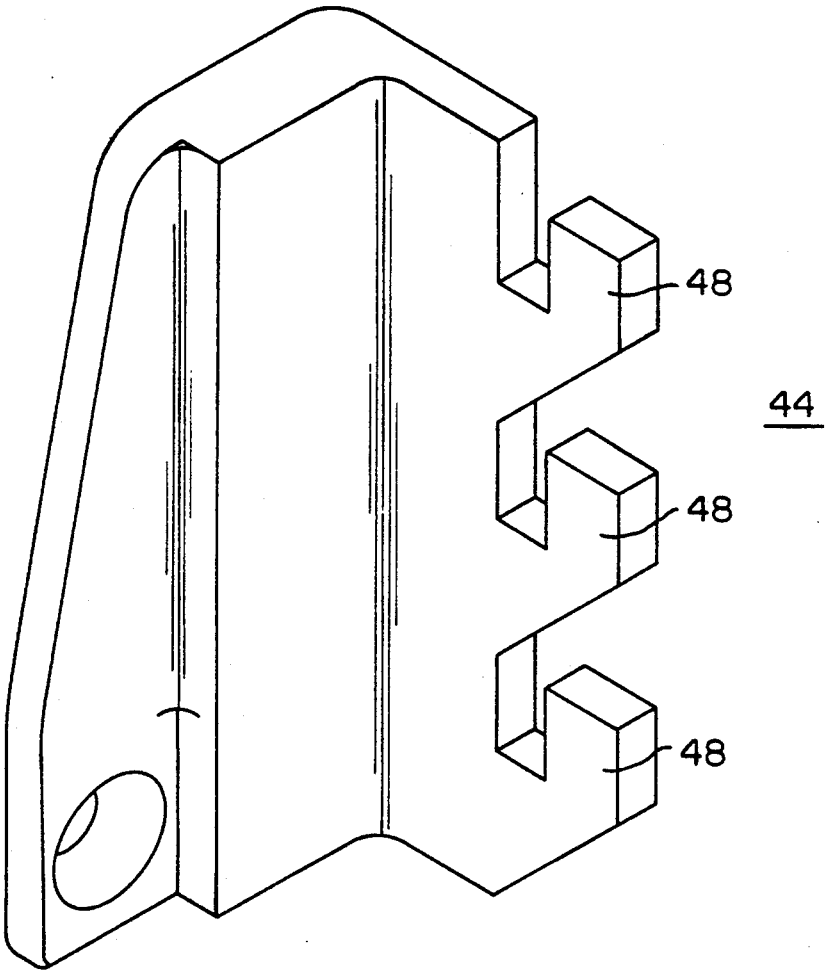
FIG. 2 is a perspective view of a jig for the furniture lifting apparatus of the present invention.

Attached to housing 16 is a jig 44. Jig 44 may be more easily seen from FIG. 2. Jig 44 is removably mounted to housing 16 by means of a threaded fastener 46. Any conventional means of removable mounting may be used. Jig 44 is shaped to include hooks 48. The particular configuration of the hooks will depend upon the brand of furniture with which the apparatus is intended to be used. Competing manufacturers of furniture configure their accessory hanging tracks differently. In this way, the manufacturer can assure that only its own accessories be used with its furniture. For this reason, jig 44 is made easily interchangeable. Each jig would therefore have a different configuration of hooks 48, adapted to mate with the particular furniture desired to be moved.

Furniture lifting apparatus 10 is also equipped with a lateral stabilizer 50. Lateral stabilizer 50 comprises a bracket 52 and a roller 54. Roller 54 rests against the furniture panel to be lifted. As the panel is lifted, it helps stabilize the panel, to prevent lateral movement on jig 44. Roller 54 allows for easy movement of the panel vertically, with little or no lateral movement. Lateral stabilizer 50 may also help to stabilize the furniture lifting apparatus.

Figure 3:
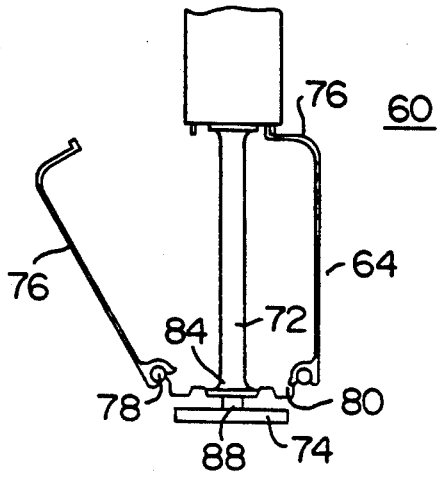
FIG. 3 is a partial cross-sectional side view of a bottom portion of a furniture panel.
Figure 4:
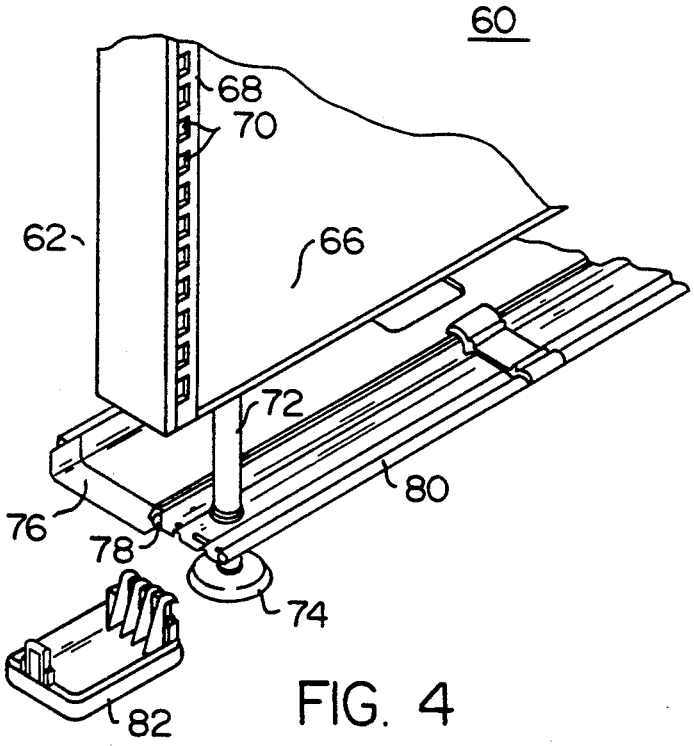
FIG. 4 is a partial perspective view of a lower corner portion of a furniture panel.

Referring now to FIGS. 3 and 4, a typical furniture panel 60 comprises an upper planar portion 62 and a lower raceway 64. Upper planar portion 62 includes the panel face 66 and accessory hanging track 68 having slots 70. Panel 60 is supported by legs and feet. One such leg 72 and one such foot 74 are shown in FIGS. 3 and 4. Feet 74 are generally fastened into legs 72 with threaded fasteners and are vertically adjustable to allow for leveling and secure placement on uneven floors.

Raceway 64 generally comprises cover plates 76 which are attached by hinges 78 to a raceway floor 80. Cover plates 76 may be folded back to allow for placement of electrical, telephone and computer wiring. An end cap 82 may be used where the panel is an end panel. Cover plates 76 and raceway floor 80 are generally fabricated of thin metal (aluminum or steel) or plastic. Thus, these components are somewhat fragile, and attempts to lift or support panel 60 by supporting raceway floor 80 or cover plates 76 usually turns out to be destructive to raceway 64.

Figure 5:
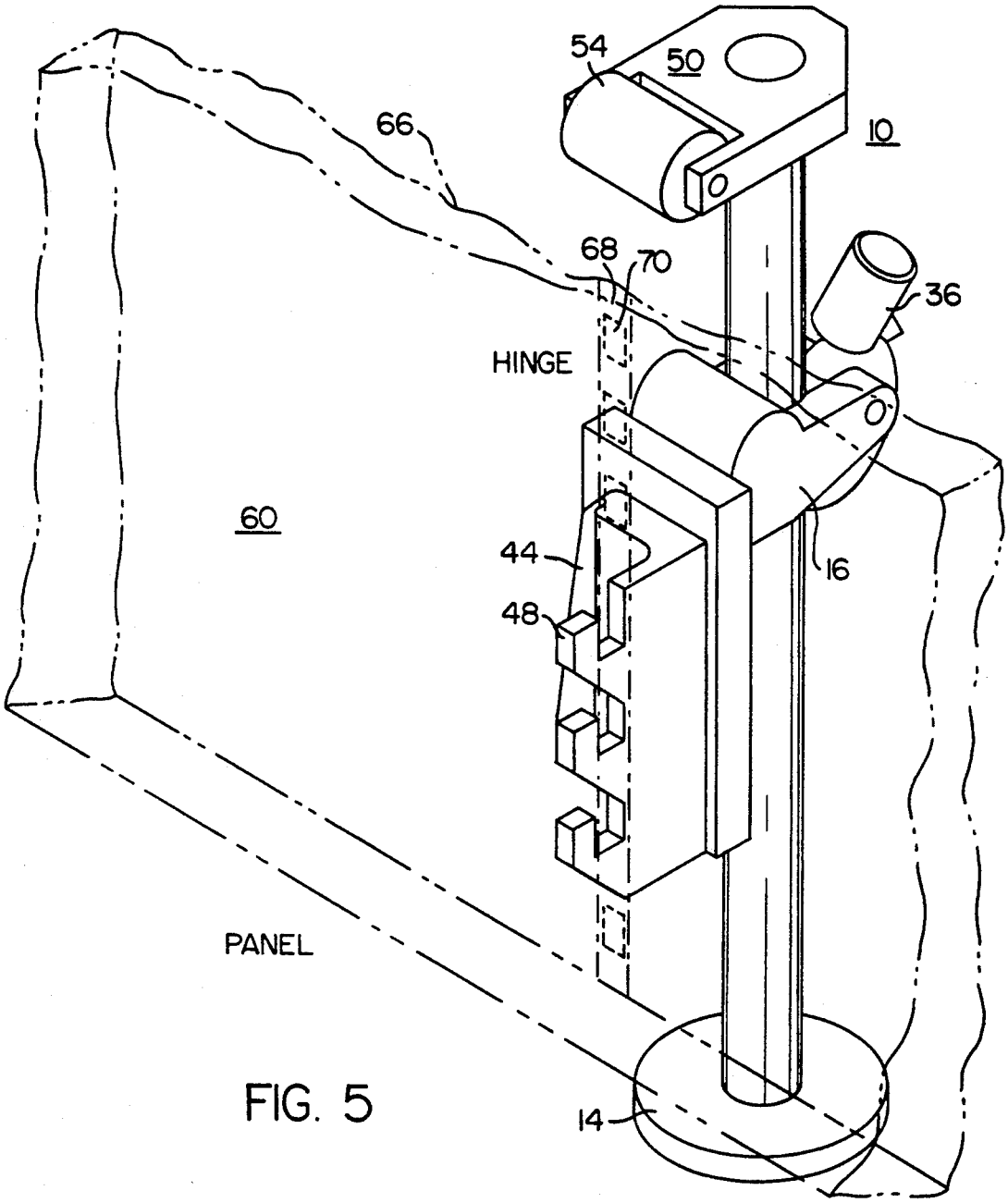
FIG. 5 is a cutaway perspective view of the furniture lifting apparatus of the present invention secured to a furniture panel.

Referring now to FIG. 5, furniture lifting apparatus 10 is placed next to furniture panel 60. Jig 44 with hooks 48 is fitted into accessory hanging tracks 68. Accessory hanging tracks 68 are equipped with slots 70 for hanging accessories. It is these slots which are used by hooks 48 to create a secure connection to accessory hanging tracks 68 and panel 60. Roller 54 is placed against panel face 66. Once the furniture lifting apparatus 10 is positioned, a leverage bar 40 (not shown in FIG. 5) may be inserted into upper actuator 36 and the panel may be lifted.

Generally, when panels of this type are lifted, they are part of a larger structure, where several panels are joined together to form a larger planar unit. Generally, the entire unit is lifted at one time, so that carpet may be removed and replaced underneath the entire unit. Of course, it is possible to lift only one end of such a unit to replace carpet and subsequently to lift the opposite end to replace carpet under that portion of the furniture arrangement.

Once the carpet underneath panel 60 has been replaced, the panel may be lowered by inserting a leverage bar 40 into lower actuator 38. Lower actuator 38 and the details of housing 16 are shown in FIG. 1, but are omitted from FIG. 5 for clarity.

Figure 7:
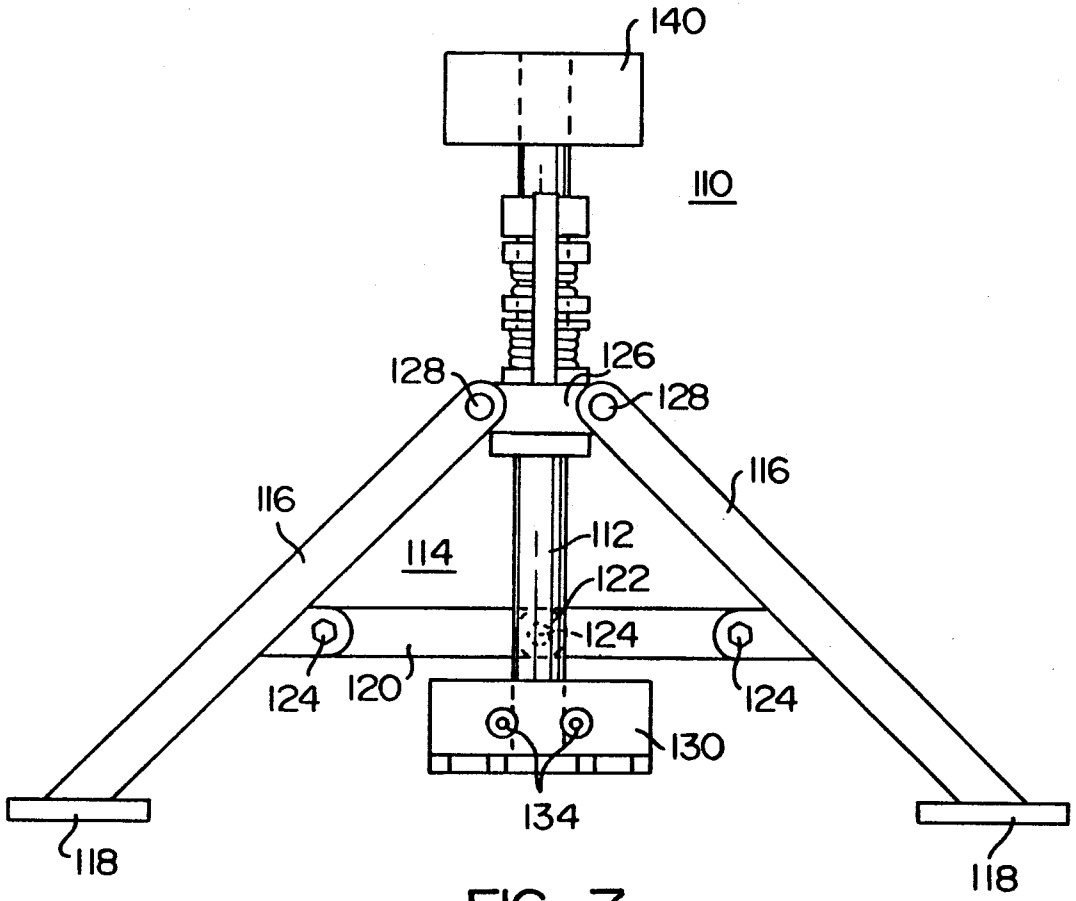
FIG. 7 is a front view of the alternative embodiment of the furniture lifting apparatus of the present invention.
Figure 6:
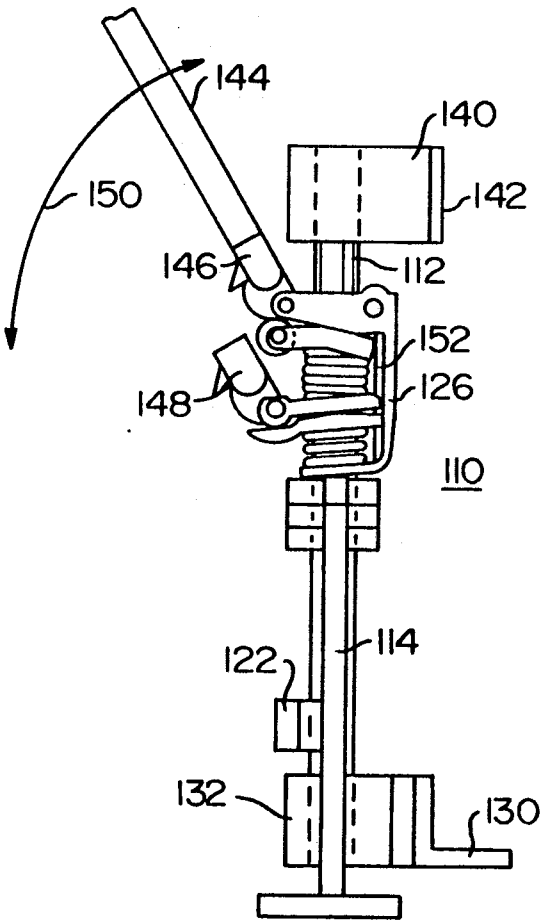
FIG. 6 is a side view of an alternative embodiment of the furniture lifting apparatus of the present invention.

Alternatively, the furniture lifting apparatus may be arranged as shown in FIGS. 6 and 7. In this arrangement, furniture lifting apparatus 110 comprises a movable central shaft 112 which is supported by a base support 114. Base support 114 has two legs 116 connected to two feet 118. Base support 114 is also equipped with crossbar 120 which is equipped with a hinge 122 in the center secured by bolt 124. Crossbar 120 is secured to legs 116 by bolts 124. Crossbar 120 is movable with respect to bolts 124 and hinge 122 which allows the unit to be folded up since legs 116 are rotatably attached to housing 126 through hinges 128. Thus the unit can be made smaller for storage or transportation. Shaft 112 is typically two feet in length and three-fourths of an inch in diameter, making the entire furniture lifting apparatus 110 compact and easily transportable.

Figure 8:
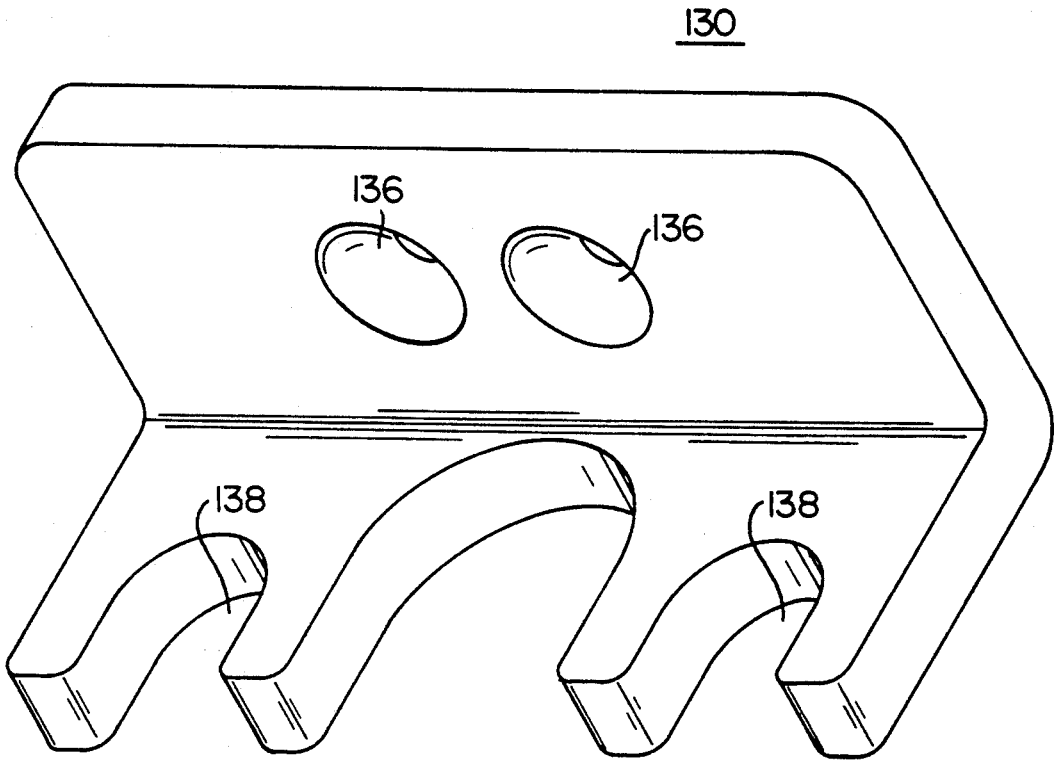
FIG. 8 is a jig adapted to be used with the alternative embodiment of the furniture lifting apparatus of the present invention.

In the arrangement shown in FIGS. 6 and 7, central shaft 112 is movable with respect to base support 114. Nevertheless, this furniture lifting apparatus operates in substantially the same fashion as described with respect to FIG. 1 and furniture lifting apparatus 10. In this case, housing 126 is secured to base 114. Jig 130 is therefore secured to central shaft 112 by means of a bracket 132. Jig 130 may be more easily seen from FIG. 8. Jig 130 is removably mounted to bracket 132 by means of threaded fasteners 134 which project through holes 136 in jig 130.

Secured to the top of shaft 112 is a lateral stabilizer 140. In this case, lateral stabilizer 140 does not have a roller, since shaft 112 will move vertically with panel 60. Jig 130 also has recesses 138. Jig 130 fits between foot 74 and leg 72 in panel 60 shown in FIGS. 3 and 4. Jig 130 supports leg 72 by means of flange 84 on leg 72 and receives threaded shaft 86 of foot 74 in one of the recesses 138. Jig 130 has two such recesses 138 and is designed specifically to accept the legs 72 of two adjacent panels. By thus accepting the legs of two adjacent panels, the panels are locked together by jig 130 when the two adjacent panels are raised.

When the furniture lifting apparatus 110 is fitted on a furniture panel to be lifted, the face 142 of lateral stabilizer 140 abuts panel face 60. To raise the panel, a leverage bar 144 is placed in upper actuator 146 and reciprocated as shown by arrow 150. To lower the mechanism and furniture panel, leverage bar 144 is inserted in lower actuator 148 and reciprocated. Conventional jacking mechanism 152 operates in the same manner as conventional jacking mechanism 18 shown in FIG. 1 and described earlier. When raising and lowering furniture panel 60, lateral stabilizer 140 stabilizes the panel 60 and jacking mechanism 110. However, some lateral movement is possible since hinges 128 allow shaft 112 and associated jig 130 and lateral stabilizer 140 to rotate slightly from side to side about hinges 128.

It is understood that various other modifications will be apparent to and can be readily made by those skilled in the art without departing from the scope and spirit of this invention. Accordingly, it is not intended that the scope of the claims appended hereto be limited to the description as set forth herein but rather that the claims be construed as encompassing all the features of patentable novelty that reside in the present invention, including all features that would be treated as equivalents thereof by those skilled in the art to which this invention pertains.

What is claimed:

1. An apparatus for lifting modular furniture having accessory hanging tracks, legs, and feet, said apparatus comprising:

a base support;

a shaft and housing assembly arranged for relative sliding movement of said housing along said shaft, one of said shaft and said housing secured to said base support, whereby the secured component of said shaft and housing assembly remains stationary relative to said base support and the other component of said shaft and housing assembly is movable relative to said base support;

means coupled to said movable component of said shaft and housing assembly for moving said movable component relative to said base support; and a jig:

(a) attached to said movable component of said shaft and housing assembly, (b) movable with said movable component when attached thereto, and (c) having a furniture engaging portion including three vertically coplanar rectangular slots.

2. The apparatus of claim 1 wherein said jig is removably attached to said movable component of said shaft and housing assembly.

3. The apparatus of claim 1 further including means attached to said shaft and adapted to contact a selected portion of said modular furniture for preventing lateral movement of said furniture and lifting apparatus, when said furniture is lifted.

4. The apparatus of claim 1 wherein said shaft is secured to said base support.

5. The apparatus of claim 1 wherein said housing is secured to said base support.

6. The apparatus of claim 4 further including means attached to said shaft and adapted to contact a selected portion of said modular furniture for preventing lateral movement of said furniture and lifting apparatus, when said furniture is lifted.

7. The apparatus of claim 5 further including means attached to said shaft and adapted to contact a selected portion of said modular furniture for preventing lateral movement of said furniture and lifting apparatus, when said furniture is lifted.

8. The apparatus of claim 6 wherein said jig is removably attached to said movable component of said shaft and housing assembly.

9. The apparatus of claim 7 wherein said jig is removably attached to said movable component of said shaft and housing assembly.

10. The apparatus of claim 8 wherein said jig is adapted to engage accessory hanging tracks on said furniture.

11. The apparatus of claim 9 wherein said jig is adapted to engage at least one foot projecting downward from said furniture panel.

12. The apparatus of claim 10 wherein said jig includes two parallel vertical rows of three vertically coplanar rectangular slots each.

13. The apparatus of claim 11 wherein said jig includes a plurality of openings adapted to engage a plurality of feet projecting downward from adjacent panels of said furniture.

14. An apparatus for lifting modular furniture having accessory hanging tracks, legs, and feet, said apparatus comprising:

a base support;

a shaft and housing assembly arranged for relative sliding movement of said housing along said shaft, said shaft secured to said base support, whereby said shaft remains stationary relative to said base support, and said housing is movable relative to said base support;

means coupled to said housing for moving said housing relative to said shaft and base support; and a jig removably attached to said housing, and having a furniture engaging portion including three vertically coplanar rectangular slots.

15. The apparatus of claim 14 wherein said jig is adapted to engage accessory hanging tracks on said furniture.

16. An apparatus for lifting modular furniture having accessory hanging tracks, legs, and feet, said apparatus comprising:

a base support;

a shaft and housing assembly arranged for relative sliding movement of said housing along said shaft, said housing secured to said base support, whereby said housing remains stationary relative to said base support and said shaft is movable relative to said base support;

means coupled to said shaft for moving said shaft relative to said base support; and a jig, attached to said shaft, movable with said shaft when attached thereto, and having a furniture engaging portion including a vertical planar portion and a horizontally planar portion extending from said vertical planar portion at a right angle thereto, said horizontal planar portion including two horizontally coplanar elongated semi-circular recesses.

17. The apparatus of claim 16 wherein said jig is adapted to engage at least one foot projecting downward from said furniture panel.

18. The apparatus of claim 15 further including means attached to said shaft and adapted to contact a selected portion of said modular furniture for preventing lateral movement of said furniture and lifting apparatus, when said furniture is lifted.

19. The apparatus of claim 17 further including means attached to said shaft and adapted to contact a selected portion of said modular furniture for preventing lateral movement of said furniture and lifting apparatus, when said furniture is lifted.

* * * * *